US010190337B2

(12) United States Patent
Min et al.

(10) Patent No.: US 10,190,337 B2
(45) Date of Patent: Jan. 29, 2019

(54) METHODS AND SYSTEMS OF ELECTRONIC AND MECHANICAL DUAL COMBINATION LOCKS

(71) Applicant: Hao Min, Jiangsu (CN)

(72) Inventors: Hao Min, Nanjing (CN); Zhangping Gong, Nanjing (CN); Jianping Sun, Nanjing (CN)

(73) Assignee: NANJING EASTHOUSE ELECTRICAL CO., LTD., Nanjing, Jiangsu (CN)

( * ) Notice: Subject to any disclaimer, the term of this patent is extended or adjusted under 35 U.S.C. 154(b) by 0 days.

(21) Appl. No.: 15/022,201

(22) PCT Filed: Dec. 16, 2014

(86) PCT No.: PCT/CN2014/093983

§ 371 (c)(1),
(2) Date: Mar. 15, 2016

(87) PCT Pub. No.: WO2015/165267

PCT Pub. Date: Nov. 5, 2015

(65) Prior Publication Data

US 2017/0051531 A1 Feb. 23, 2017

(30) Foreign Application Priority Data

Apr. 29, 2014 (CN) ..... 2014 1 0175815
Apr. 29, 2014 (CN) ..... 2014 1 0176302

(51) Int. Cl.
*E05B 49/00* (2006.01)
*E05B 47/00* (2006.01)
(Continued)

(52) U.S. Cl.
CPC ..... *E05B 49/00* (2013.01); *E05B 17/10* (2013.01); *E05B 37/00* (2013.01); *E05B 37/20* (2013.01);
(Continued)

(58) Field of Classification Search
CPC ..... E05B 37/00; E05B 37/02; E05B 37/08; E05B 47/00; E05B 47/0001; E05B 47/06; E05B 49/00; E05B 65/0075
See application file for complete search history.

(56) References Cited

U.S. PATENT DOCUMENTS 4,671,086 A * 6/1987 Fogleman ..... E05B 47/0002 292/144
4,831,851 A * 5/1989 Larson ..... E05B 47/0002 70/277

(Continued)

*Primary Examiner* — Christopher J Boswell
(74) *Attorney, Agent, or Firm* — Ming Jiang; MM IP Services LLC

(57) ABSTRACT

The present invention relates to electronic and mechanical dual combination locks. In certain embodiments, electronic and mechanical dual combination locks include: a lock base, a spin dial, a spin dial cover, and a spin dial release conversion mechanism. The lock base includes a mechanical combination lock inside. An electronic combination lock is positioned inside the spin dial cover. The spin dial release conversion mechanism has a spin dial release positioned on the top of the lock base. The spin dial release is used by the user to switch the electronic and mechanical dual combination lock between the electronic combination lock and the mechanical combination lock. When spin dial release is placed in a first position, the electronic and mechanical dual combination lock becomes the electronic combination lock. When the spin dial release is placed in a second position, the electronic and mechanical dual combination lock becomes the mechanical combination lock.

20 Claims, 9 Drawing Sheets

(51) Int. Cl.

| | |
|---|---|
| ***E05B 37/00*** | (2006.01) |
| ***G07C 9/00*** | (2006.01) |
| ***E05B 17/10*** | (2006.01) |
| ***E05B 37/20*** | (2006.01) |
| ***E05B 65/00*** | (2006.01) |

(52) U.S. Cl.
CPC ..... *E05B 47/00* (2013.01); *E05B 65/0075* (2013.01); *G07C 9/00666* (2013.01); *E05B 2047/0058* (2013.01)

(56) References Cited

U.S. PATENT DOCUMENTS 4,967,577 A * 11/1990 Gartner ..... E05B 37/08 70/279.1
5,184,491 A * 2/1993 Schittenhelm ..... E05B 37/08 70/278.1
5,487,290 A * 1/1996 Miller ..... E05B 17/2084 292/142
5,540,068 A * 7/1996 Gartner ..... E05B 37/08 70/277
5,684,457 A * 11/1997 Miller ..... E05B 37/00 307/119
5,881,589 A * 3/1999 Clark ..... E05B 47/0012 70/278.7
5,887,467 A * 3/1999 Butterweck ..... E05B 41/00 292/144
6,116,066 A * 9/2000 Gartner ..... E05B 41/00 292/348
6,341,513 B1 * 1/2002 Chen ..... E05B 37/00 70/279.1
8,091,392 B2 * 1/2012 Miller ..... E05B 9/00 70/333 A
8,856,893 B2 * 10/2014 Min ..... H04L 9/3215 726/3
9,080,349 B2 * 7/2015 Burrus ..... E05B 37/00
9,340,999 B2 * 5/2016 Romero ..... E05B 47/0684
9,487,971 B2 * 11/2016 Quach ..... E05B 47/0012
9,657,500 B2 * 5/2017 Min ..... E05B 47/00
9,816,294 B2 * 11/2017 Burrus ..... E05B 37/00
9,822,555 B2 * 11/2017 Min ..... E05B 17/208

* cited by examiner

METHODS AND SYSTEMS OF ELECTRONIC AND MECHANICAL DUAL COMBINATION LOCKS

CROSS-REFERENCE TO RELATED APPLICATION

This application is a continuation of a PCT/CN2014/093983, filed with the State Intellectual Property Office of China on Dec. 16, 2014, entitled "Methods and Systems of Electronic and Mechanical Dual Combination Locks", by Zhangping GONG, Jianping SUN, and Hao MIN, which claims priority of Chinese Patent Application No. 201410175815.3, filed on Apr. 29, 2014, entitled "Methods and Systems of Electronic and Mechanical Dual Combination Locks" by Zhangping GONG, Jianping SUN, and Hao MIN, the disclosures of which are incorporated herein by reference in their entirety.

Some references, if any, which may include patents, patent applications and various publications, may be cited and discussed in the description of this invention. The citation and/or discussion of such references, if any, is provided merely to clarify the description of the present invention and is not an admission that any such reference is "prior art" to the invention described herein. All references listed, cited and/or discussed in this specification are incorporated herein by reference in their entireties and to the same extent as if each reference was individually incorporated by reference.

FIELD

The present disclosure generally relates to locks for safe or vault, and more particularly to methods and systems of electronic and mechanical dual combination locks.

BACKGROUND

Existing locks for use in safes or vaults are generally independent mechanical combination locks or independent electronic combination locks. The mechanical combination locks are divided into regular mechanical combination locks and high-security mechanical combination locks. The regular mechanical combination locks have a small number of combinations and are less secure, while the high-security mechanical combination locks have a large number of combinations, and are more secure. However, the high-security mechanical combination locks are difficult to operate. Combinations are difficult to remember, and resetting the combinations are tedious and cumbersome operations, causing poor user experiences. On the other hand, electronic combination locks have capability of more complex combinations, passcode entering and resetting are relatively convenient, causing better user experiences. However, the electronic combination locks have more electronic components and complex structure, and are prone to failures because of environmental elements such as moisture, strong electro-magnetic fields, and vibration.

Therefore, a heretofore unaddressed needs still exist in the art to address the aforementioned deficiencies and inadequacies.

SUMMARY

In one aspect, the present invention relates to an electronic and mechanical dual combination lock. In certain embodiments, the electronic and mechanical dual combination lock includes: a lock base, a spin dial, a spin dial cover, and a spin dial release conversion mechanism. The lock base includes a mechanical combination lock inside. The spin dial is used by a user for locking and unlocking the mechanical combination lock. Outside of the spin dial, there is the spin dial cover, and an electronic combination lock is positioned inside the spin dial cover. An electronic and mechanical locking mechanism is electronically and mechanically coupled to the electronic and mechanical dual combination lock to perform the locking and unlocking operations. The spin dial release conversion mechanism has a spin dial release positioned on the top of the lock base. The spin dial release is used by the user to switch the electronic and mechanical dual combination lock between the electronic combination lock and the mechanical combination lock. When the spin dial release is placed in a first position, the electronic and mechanical dual combination lock acts as the electronic combination lock. When the spin dial release is placed in a second position, the electronic and mechanical dual combination lock acts as the mechanical combination lock.

In certain embodiments, when the spin dial release is placed in the first position, the spin dial release is pressed down. When the spin dial release is placed in the second position, the spin dial release is lifted up. The top portion of the spin dial release is in an arc shape, and when the spin dial release is in the first position, the arc shape of the spin dial release forms a part of the circular shape of the lock base.

In certain embodiments, the mechanical combination lock includes: multiple wheel packs, a drive cam; a dial ring, and a spin dial release wheel. The drive cam is mechanically coupled to the spin dial through a spindle. The spindle is used to turn the wheel packs. The dial ring has many numerical markings, and the numerical markings is displayed along the edge of the dial ring. These numerical markings are used by a user to turn the spindle according to a predetermined sequences for locking or unlocking the electronic and mechanical dual combination lock. A spin dial release opening is defined at a top center portion of the spin dial release wheel. When the spin dial release is in the first position, the spin dial release is locked by a locking block on the spin dial release through the spin dial release opening. When the spin dial release is locked by the locking block, the electronic and mechanical dual combination lock is converted to the electronic combination lock. When the spin dial release is in the second position, the locking block on the spin dial release is released from the spin dial release wheel. When the locking block on the spin dial release is released from the spin dial release wheel, the electronic and mechanical dual combination lock is converted to the mechanical combination lock.

In certain embodiments, the spin dial release includes a light emit diode (LED) positioned inside the top of the spin dial release configured to illuminate the numerical markings along the edge of the dial ring. The spin dial cover has many dial ring notches. These dial ring notches are used by the user to hold and spin the spin dial cover. The spin dial release wheel also has many spin dial release wheel notches. These spin dial release wheel notches are used to mate with the equal number of dial ring notches of the spin dial cover such that when the spin dial release is in the second position, and when the user turns the spin dial cover, the spin dial cover turns the spin dial release wheel to lock and unlock the mechanical combination lock.

In certain embodiments, the electronic combination lock includes: a combination keypad, a battery, an electronic circuit board, a first control output connector, and a second control output connector. The combination keypad have a number of numerical keys. These numerical keys are used by the user to enter one or more predetermined multiple digit combination codes for locking or unlocking the electronic and mechanical dual combination lock. The battery supplies electric power to the electronic combination lock. All necessary electronic components for the electronic combination lock are installed on the electronic circuit board, and the electronic circuit board is electrically coupled to the combination keypad, and the battery. The first control output connector has certain control wires electrically coupled to the electronic circuit board, and the second control output connector has certain control wires electrically coupled to the electronic and mechanical locking mechanism.

In certain embodiments, the electronic circuit board has an electronic combination lock control circuit. The electronic combination lock control circuit receives the predetermined multiple digit combination codes from the combination keypad, compares with the authorized combination codes stored in a memory of the electronic circuit board, and transmits control signals through the second control output connector to the electronic and mechanical locking mechanism to lock and unlock the electronic and mechanical dual combination lock. When the spin dial release is in the first position, the first control output connector is connected to the second control output connector. When the spin dial release is in the second position, the first control output connector is disconnected from the second control output connector.

In another aspect, the present invention relates to a method of using an electronic and mechanical dual combination lock. In certain embodiments, the method includes: installing the electronic and mechanical dual combination lock on a safe, pressing down the spin dial release to a first position to use the electronic combination lock, and lifting up the spin dial release to a second position to use the mechanical combination lock. The electronic and mechanical dual combination lock includes: a lock base, a spin dial, a spin dial cover, and a spin dial release conversion mechanism. The lock base includes a mechanical combination lock positioned inside the lock base. The spin dial is used for the mechanical combination lock. An electronic combination lock is installed inside the spin dial cover. An electronic and mechanical locking mechanism is used for locking and unlocking the safe. The spin dial release conversion mechanism has a spin dial release positioned on the top of the lock base. The spin dial release is used for switching the electronic and mechanical dual combination lock between the electronic combination lock and the mechanical combination lock.

In certain embodiments, when the spin dial release is placed in the first position, the spin dial release is pressed down. When the spin dial release is in the second position, the spin dial release is lifted up. The top portion of the spin dial release is in an arc shape, and when the spin dial release is in the first position, the arc shape of the spin dial release forms a part of the circular shape of the lock base.

In certain embodiments, the mechanical combination lock includes: multiple wheel packs, a drive cam, a dial ring, and a spin dial release wheel. The drive cam is mechanically coupled to the spin dial through a spindle configured to turn the wheel packs. The dial ring has numerical markings engraved along the edge of the dial ring. These numerical markings are used by a user to turn the spindle for locking or unlocking the electronic and mechanical dual combination lock. A spin dial release opening is defined at a top center portion of the spin dial release wheel. When the spin dial release is in the first position, the spin dial release is locked by a locking block on the spin dial release through the spin dial release opening. When the spin dial release is locked by the locking block, the electronic and mechanical dual combination lock is converted to the electronic combination lock. When the spin dial release is in the second position, the locking block on the spin dial release is released from the spin dial release wheel. When the locking block on the spin dial release is released from the spin dial release wheel, the electronic and mechanical dual combination lock is converted to the mechanical combination lock.

In certain embodiments, the dial ring of the mechanical combination lock includes numerical markings along the edge of the dial ring. These numerical markings is used by the user to lock and unlock the mechanical combination lock. The spin dial release includes an LED light positioned inside the top of the spin dial release. The LED light is used to illuminate the numerical markings along the edge of the dial ring.

In certain embodiments, the spin dial cover includes multiple dial ring notches allowing the user to hold and spin the spin dial cover. The spin dial release wheel also includes multiple spin dial release wheel notches. The spin dial release wheel notches is used to mate with the dial ring notches of the spin dial cover such that when the spin dial release is in the second position, and when the user turns the spin dial cover, the spin dial cover turns the spin dial release wheel to lock and unlock the mechanical combination lock.

In certain embodiments, the electronic combination lock includes: a combination keypad, a battery, an electronic circuit board, a first control output connector, and a second control output connector. The combination keypad has certain number of numerical keys. These numerical keys is used by the user to enter one or more predetermined multiple digit combination codes for locking or unlocking the electronic and mechanical dual combination lock. The battery provides electrical power to the electronic combination lock. The electronic circuit board is electrically coupled to the combination keypad, and the battery. The first control output connector has multiple control wires coupled to the electronic circuit board. The second control output connector has multiple control wires coupled to the electronic and mechanical locking mechanism. The electronic circuit board has an electronic combination lock control circuit. The electronic combination lock control circuit receives the predetermined multiple digit combination codes from the combination keypad, compares with the authorized combination codes stored in a memory of the electronic circuit board, and transmits control signals to the electronic and mechanical locking mechanism through the second control output connector to lock and unlock the electronic and mechanical dual combination lock. When the spin dial release is in the first position, the first control output connector is connected to the second control output connector, and when the spin dial release is in the second position, the first control output connector is disconnected from the second control output connector.

These and other aspects of the present invention will become apparent from the following description of the preferred embodiment taken in conjunction with the following drawings and their captions, although variations and modification therein may be affected without departing from the spirit and scope of the novel concepts of the disclosure.

BRIEF DESCRIPTION OF THE DRAWINGS

The accompanying drawings illustrate one or more embodiments of the present disclosure, and features and benefits thereof, and together with the written description, serve to explain the principles of the present invention. Wherever possible, the same reference numbers are used throughout the drawings to refer to the same or like elements of an embodiment, and wherein.

DETAILED DESCRIPTION

Figure 1:
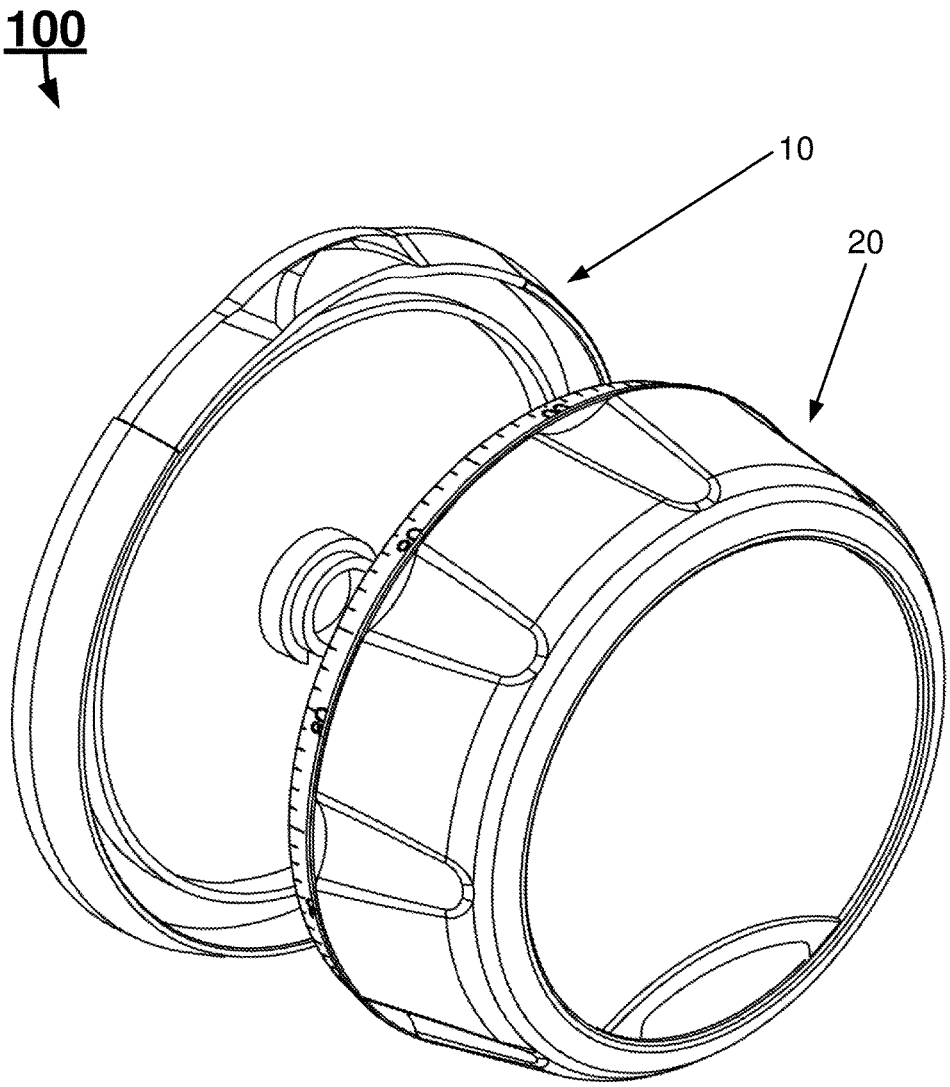
FIG. 1 shows an exploded view of an electronic and mechanical dual combination lock according to certain embodiments of the present invention.

The present disclosure is more particularly described in the following examples that are intended as illustrative only since numerous modifications and variations therein will be apparent to those skilled in the art. Various embodiments of the disclosure are now described in detail. Referring to the drawings, like numbers, if any, indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present disclosure. Additionally, some terms used in this specification are more specifically defined below.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and in no way limits the scope and meaning of the disclosure or of any exemplified term. Likewise, the disclosure is not limited to various embodiments given in this specification.

Unless otherwise defined, all technical and scientific terms used herein have the same meaning as commonly understood by one of ordinary skill in the art to which this disclosure pertains. In the case of conflict, the present document, including definitions will control.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, "plurality" means two or more.

As used herein, the terms "comprising," "including," "carrying," "having," "containing," "involving," and the like are to be understood to be open-ended, i.e., to mean including but not limited to.

As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

The present disclosure will now be described more fully hereinafter with reference to the accompanying drawings, in which embodiments of the disclosure are shown. This disclosure may, however, be embodied in many different forms and should not be construed as limited to the embodiments set forth herein; rather, these embodiments are provided so that this disclosure will be thorough and complete, and will fully convey the scope of the disclosure to those skilled in the art. Like numbers refer to like elements throughout.

Figure 2:
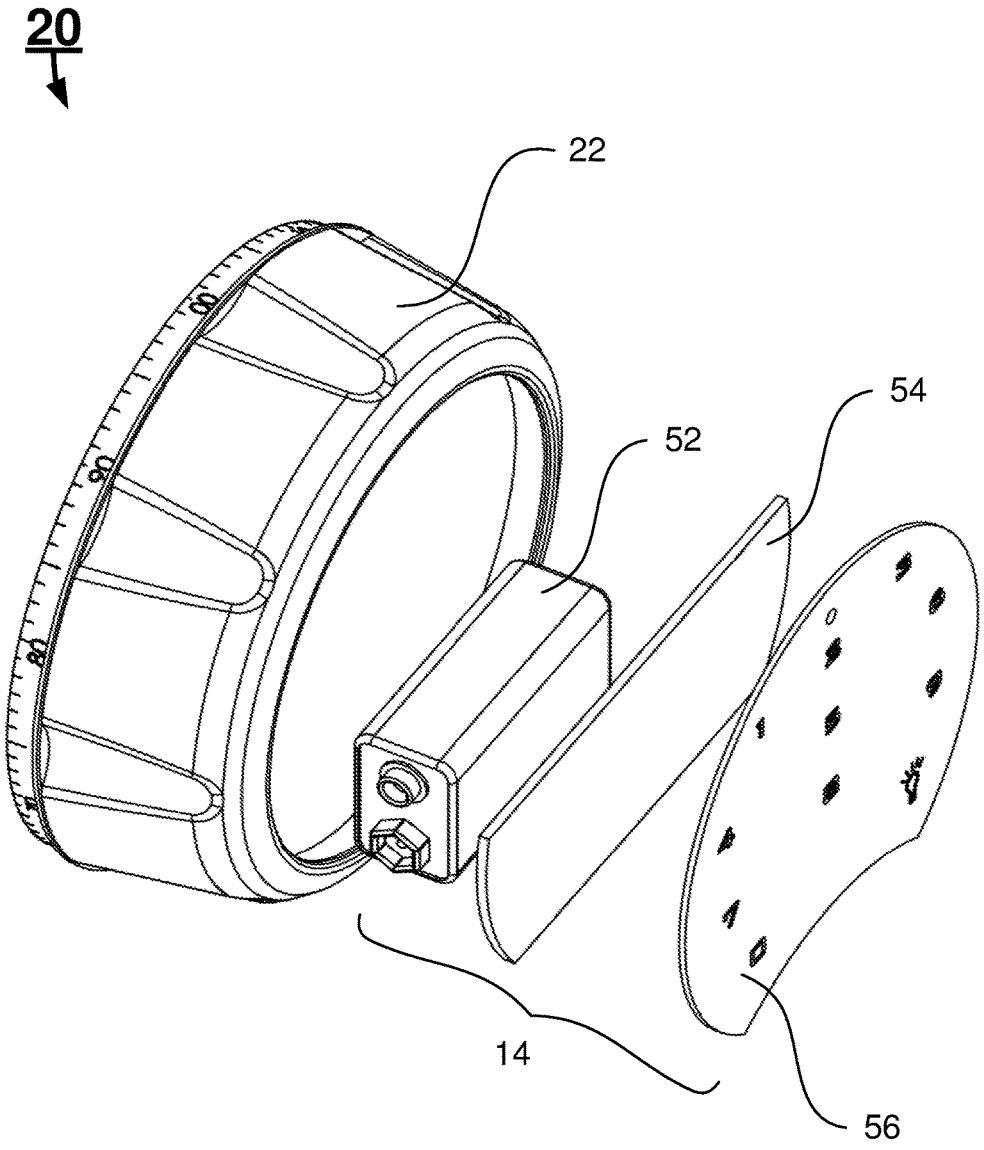
FIG. 2 shows an exploded perspective view of a spin dial of the electronic and mechanical dual combination lock according to certain embodiments of the present invention.

In one aspect, the present invention relates to an electronic and mechanical dual combination lock 100. Referring now to FIGS. 1 and 2, exploded views and a perspective view of the electronic and mechanical dual combination lock 100 are shown according to certain embodiments of the present invention. The electronic and mechanical dual combination lock 100 includes: a lock base 10, and a spin dial 20. The lock base 10 has a spin dial release conversion mechanism 40. The spin dial 20 has a spin dial cover 22, and the spin dial cover 22 has a combination keypad 56 (not shown in FIGS. 1 and 2). The lock base 10 includes a mechanical combination lock 12 (not shown in FIGS. 1 and 2) inside. An electronic combination lock 14 (as shown in FIG. 2) is positioned inside the spin dial cover 22. The combination keypad 56 is used by a user for entering one or more predetermined multiple digit combination codes for locking and unlocking the electronic combination lock 14. The spin dial 20 is used by the user for locking and unlocking the mechanical combination lock 12. An electronic and mechanical locking mechanism 60 (not shown in FIGS. 1 and 2) is electronically and mechanically coupled to the electronic and mechanical dual combination lock 100 to perform the locking and unlocking operations.

Figure 3:
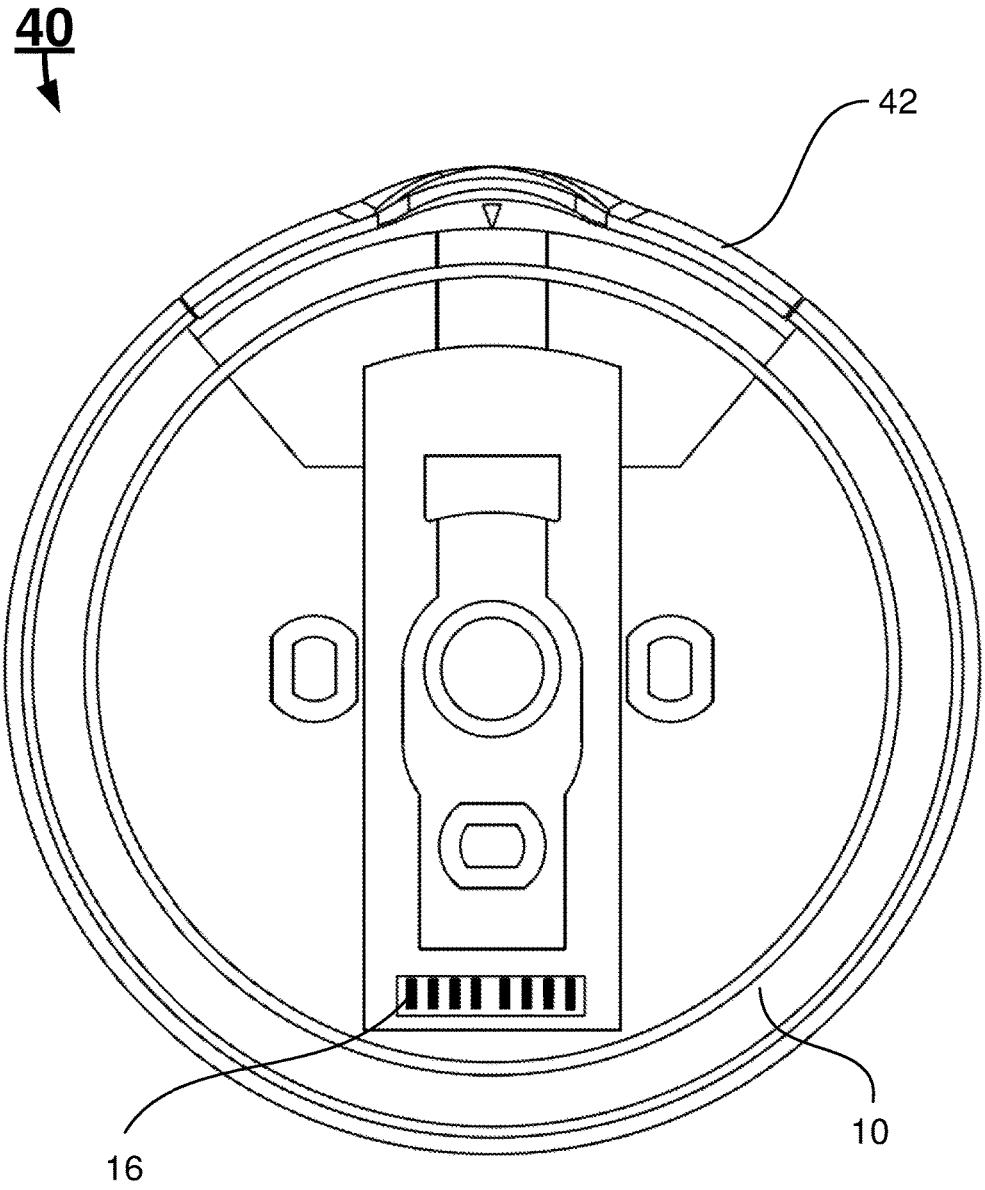
FIG. 3 is a front view of a spin dial release conversion mechanism when the spin dial release is in a first position and the electronic and mechanical dual combination lock is used as the electronic combination lock according to certain embodiments of the present invention.

Referring now to FIG. 3, a front view of the spin dial release conversion mechanism 40 is shown when the electronic and mechanical dual combination lock 100 is used as the electronic combination lock 14 according to certain embodiments of the present invention. The spin dial release conversion mechanism 40 has a spin dial release 42 positioned on the top of the lock base 10. The spin dial release 42 is used by the user to switch the electronic and mechanical dual combination lock 100 between the electronic combination lock 14 and the mechanical combination lock 12. When the spin dial release 42 is placed in a first position, the electronic and mechanical dual combination lock 100 acts as the electronic combination lock 14. When the spin dial release 42 is placed in a second position, the electronic and mechanical dual combination lock 100 acts as a mechanical combination lock 12.

Figure 4:
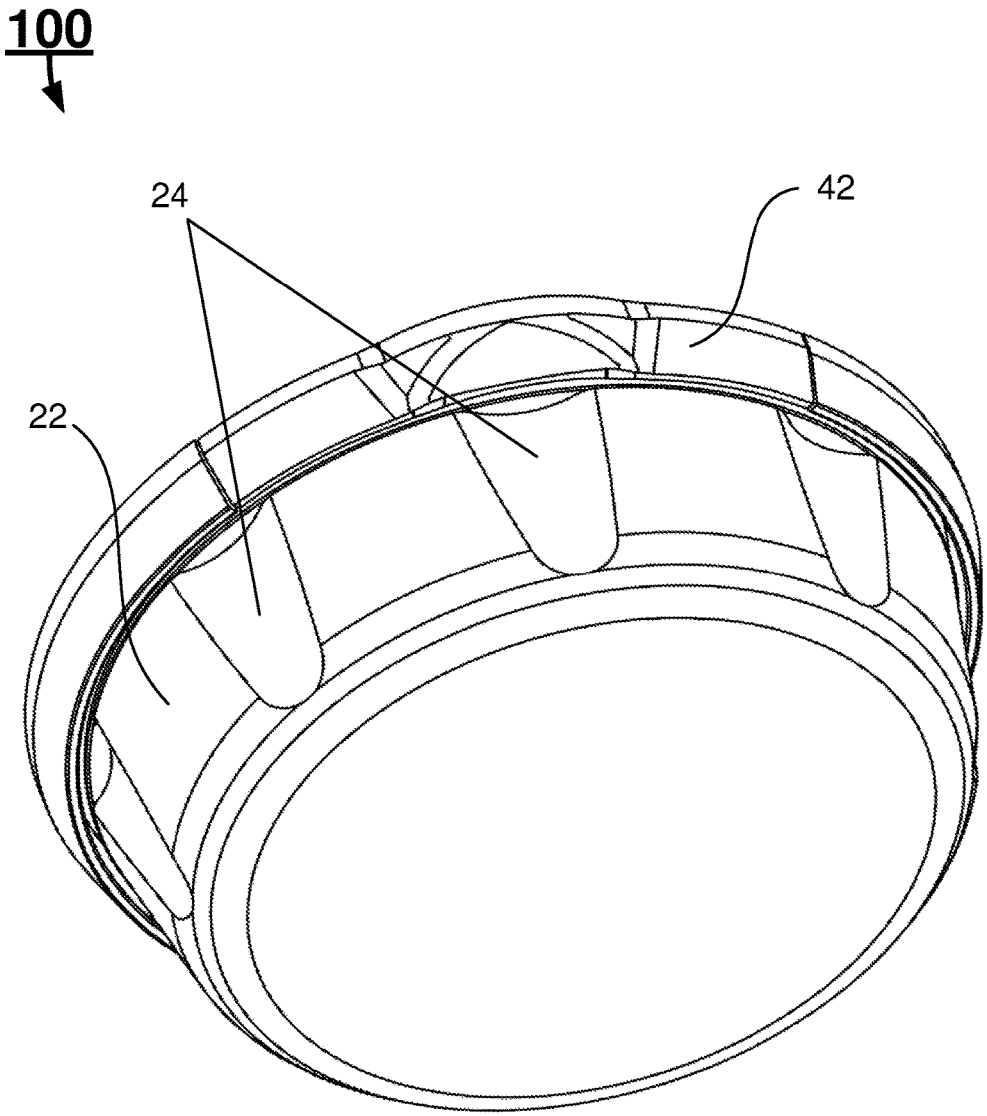
FIG. 4 shows a perspective view of the electronic and mechanical dual combination lock when a spin dial release is in the first position and the electronic and mechanical dual combination lock is used as an electronic combination lock according to certain embodiments of the present invention.
Figure 5:
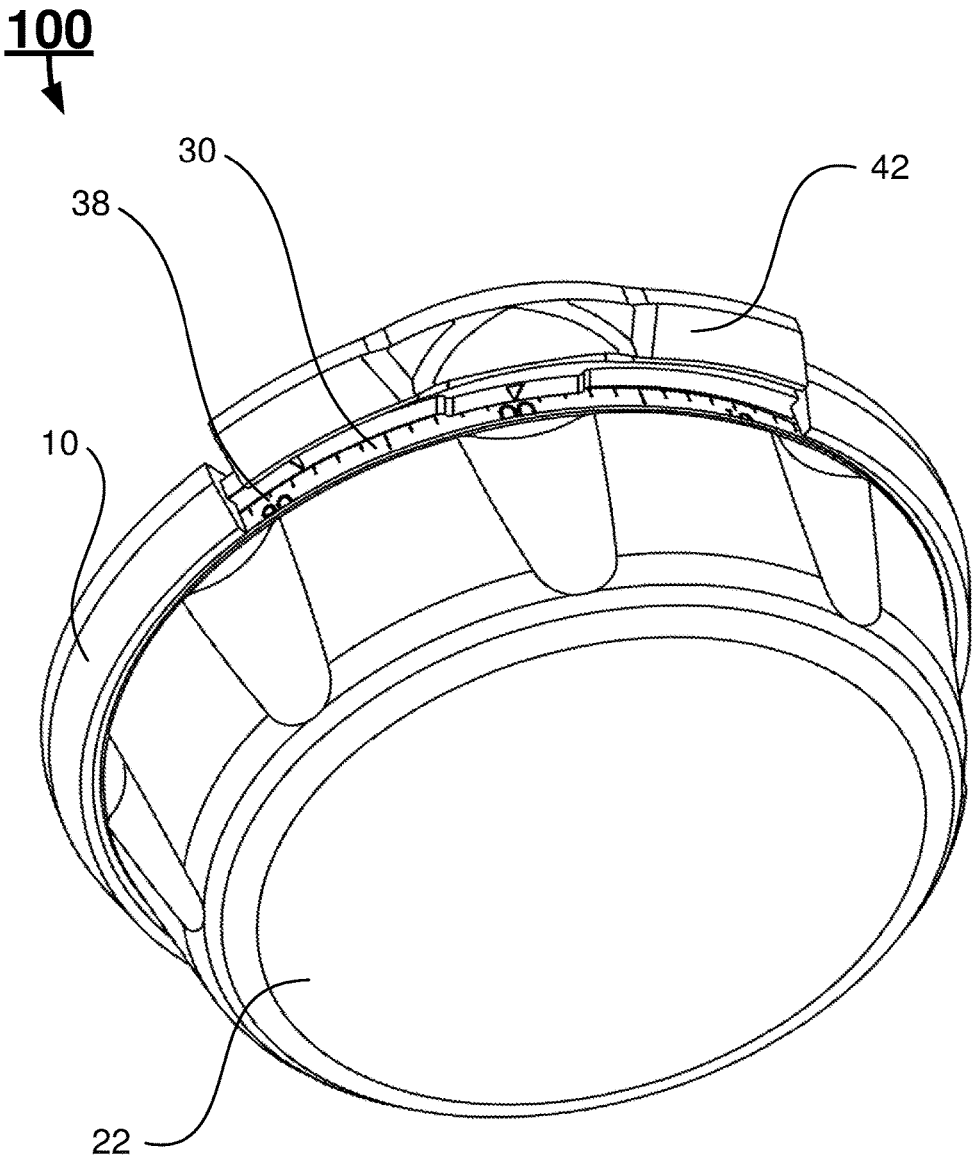
FIG. 5 shows a perspective view of the electronic and mechanical dual combination lock when the spin dial release is in a second position and the electronic and mechanical dual combination lock is used as a mechanical combination lock according to certain embodiments of the present invention.

As shown in FIG. 4, when the spin dial release 42 is placed in the first position, the spin dial release 42 is pressed down. As shown in FIG. 5, when the spin dial release 42 is placed in the second position, the spin dial release 42 is lifted up. The top portion of the spin dial release 42 is in an arc shape, and when the spin dial release 42 is in the first position, the arc shape of the spin dial release 42 forms a part of the circular shape of the lock base 10.

Figure 6:
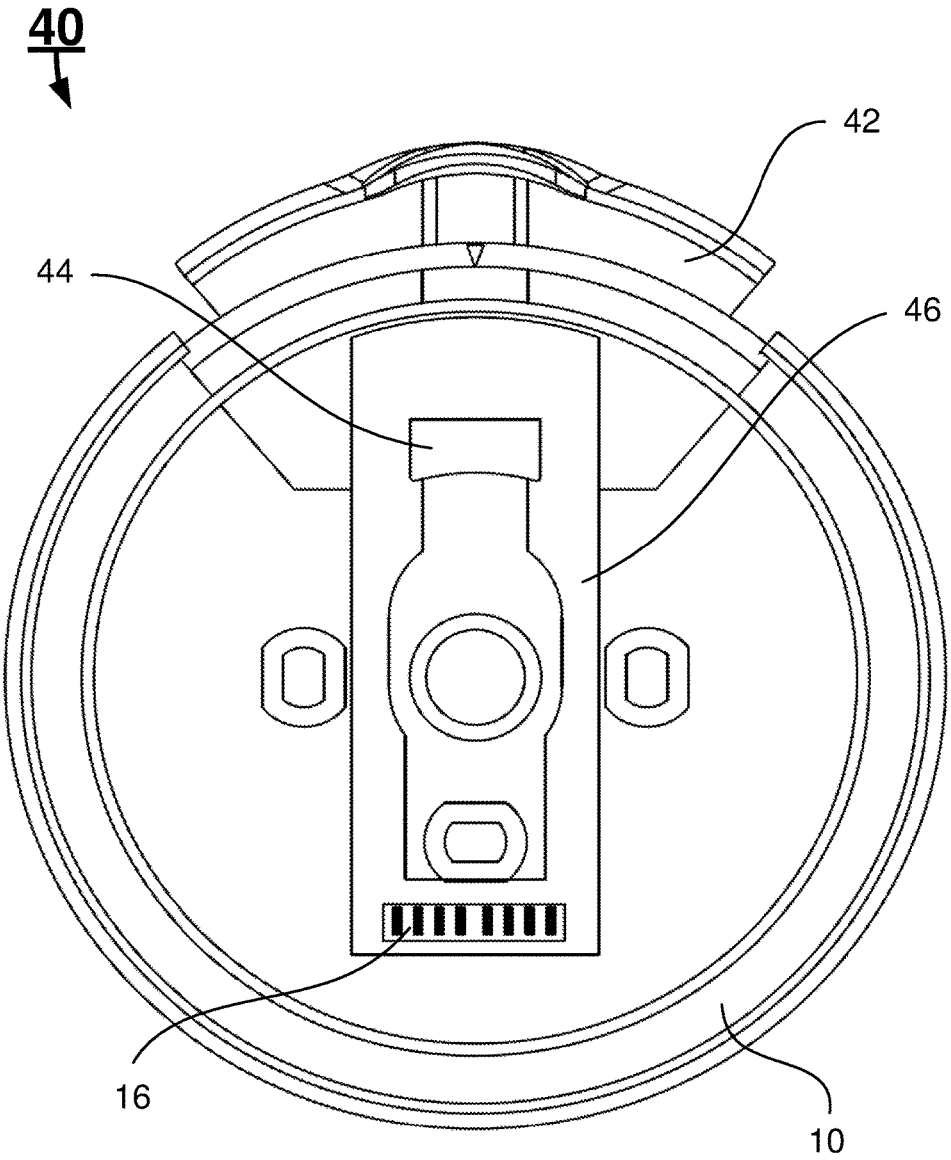
FIG. 6 is a front view of the spin dial release conversion mechanism when the spin dial release is in the second position and the electronic and mechanical dual combination lock is used as the mechanical combination lock according to certain embodiments of the present invention.
Figure 7:
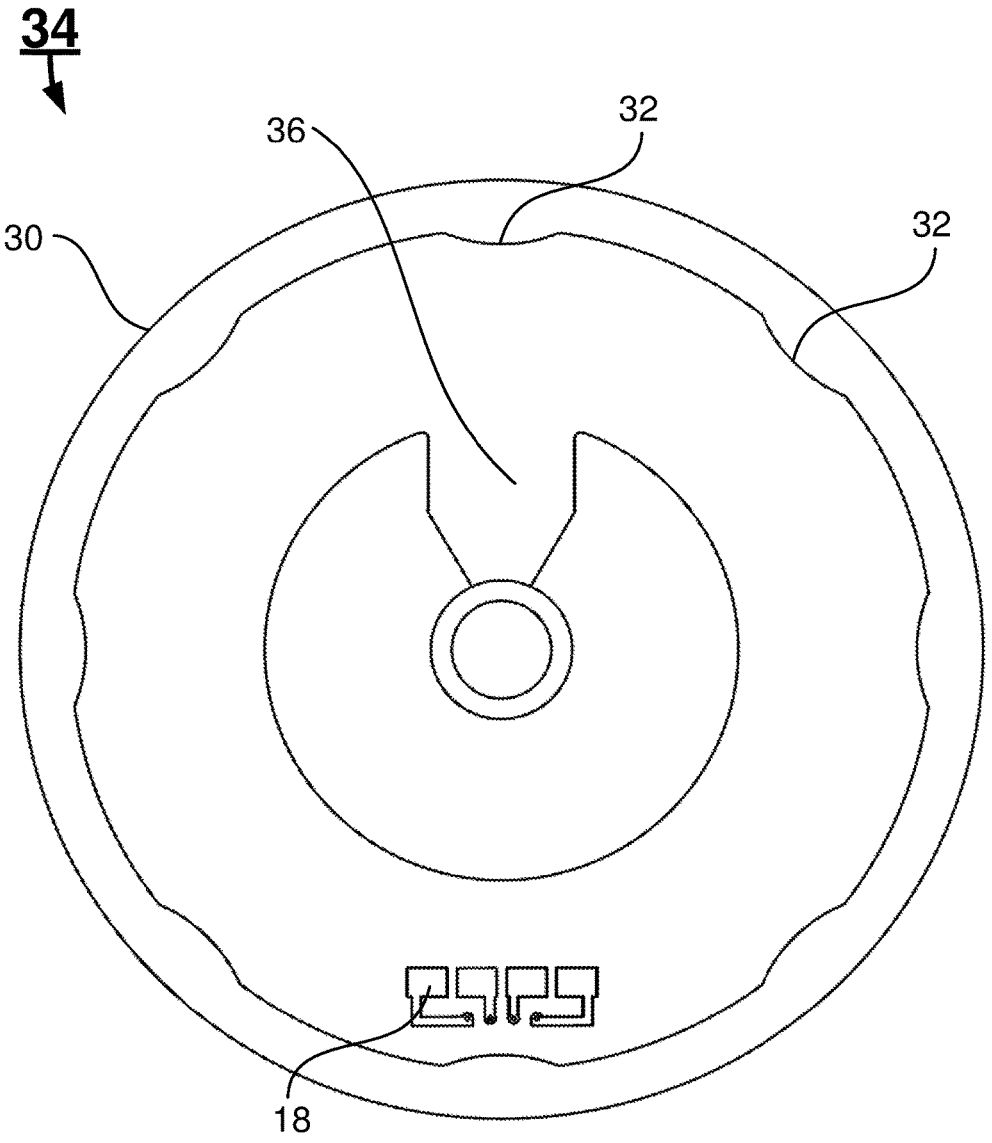
FIG. 7 is a front view of a spin dial release wheel of the electronic and mechanical dual combination lock according to certain embodiments of the present invention.

Referring now to FIG. 6, a front view of the spin dial release conversion mechanism 40 is shown when the spin dial release 42 is in the second position and the electronic and mechanical dual combination lock is used as the mechanical combination lock 12 according to certain embodiments of the present invention. The mechanical combination lock 12 includes: multiple wheel packs (not shown in FIG. 6), a drive cam (not shown in FIG. 6). In FIG. 7, a front view of a spin dial release wheel 34 of the electronic and mechanical dual combination lock 100 is shown according to certain embodiments of the present invention. The mechanical combination lock 12 also includes a dial ring 30 on the spin dial release wheel 34. The drive cam (not shown in FIGS. 6 and 7) is mechanically coupled to the spin dial 20 through a spindle (not shown in FIGS. 6 and 7). The spindle is used to turn the wheel packs. The dial ring 30 has many numerical markings 38 as shown in FIG. 5, and the numerical markings 38 is displayed along the outer perimeters of the dial ring 30. In one embodiment, the numerical markings 38 include 100 marks: 0 through 99, with the number 00, 10, 20, 30, 40, 50, 60, 70, 80, and 90 engraved along the outer perimeters of the dial ring 30. These numerical markings 38 are used by the user to turn the spindle according to a predetermined sequences for locking or unlocking the mechanical combination lock 12.

In certain embodiments, the spin dial release 42 is installed in the lock base 10. The lock base 10 has a groove and the spin dial release 42 has a protrusion that is installed inside of the grove such that the spin dial release 42 can be slide up and down freely and travel a distance defined by the groove. A spin dial release opening 36 is defined at a top center portion of the spin dial release wheel 34. The spin dial release 42 has an elongated spin dial release bar 46 extending down through an axis of the spin dial 20. The spin dial release bar 46 has a locking block 44. When the spin dial release 42 is pressed down to its first position, the spin dial release 42 is locked by the locking block 44 on the spin dial release 42 through the spin dial release opening 36. When the spin dial release 42 is locked by the locking block 44, the electronic and mechanical dual combination lock 100 is converted to the electronic combination lock 14. When the spin dial release 42 is lifted up to its second position, the locking block 44 on the spin dial release 42 is released from the spin dial release opening 36 of the spin dial release wheel 34. When the locking block 44 on the spin dial release 42 is released from the spin dial release wheel 34, the spin dial 20 can be turned freely, and the electronic and mechanical dual combination lock 100 is converted to the mechanical combination lock 12.

In certain embodiments, the spin dial release 42 includes a light emit diode (LED) light positioned inside the top of the spin dial release 42. The LED light is used to illuminate the numerical markings 38 along the edge of the dial ring 30 when the electronic and mechanical dual combination lock 100 is used as the mechanical combination lock 12. The spin dial cover 22 has many dial ring notches 24 as shown in FIG. 4. These dial ring notches 24 are used by the user to hold and spin the spin dial 20. The spin dial release wheel 34 also has many spin dial release wheel notches 32 as shown in FIG. 6. In one embodiment, the spin dial cover 22 has 8 dial ring notches 24, and the spin dial release wheel 34 also has 8 spin dial release wheel notches 32. These notches can be more or less in other embodiments. These spin dial release wheel notches 32 are used to mate with the equal number of dial ring notches 24 of the spin dial cover 22 such that when the spin dial release 42 is in the second position, and when the user turns the spin dial cover 22, the spin dial 20 turns the spin dial release wheel 34 to lock and unlock the mechanic combination lock 12.

Referring back to FIG. 2, in certain embodiments, the electronic combination lock 14 includes: a combination keypad 56, a battery 52, an electronic circuit board 54, a first control output connector 16, and a second control output connector 18. The combination keypad 56 have a number of numerical keys. In one embodiment, the numerical keys include: numerical keys 0 through 9, and a clear key. These numerical keys are used by the user to enter one or more predetermined multiple digit combination codes for locking or unlocking the electronic and mechanical dual combination lock 100. The battery 52 supplies electric power to the electronic combination lock 14. All necessary electronic components for the electronic combination lock 14 are installed on the electronic circuit board 54, and the electronic circuit board 54 is electrically coupled to the combination keypad 56, and the battery 52.

In certain embodiments, the electronic circuit board 54 has an electronic combination lock control circuit. All necessary electronic components of the electronic combination lock control circuit are installed on the electronic circuit board 54. When the electronic and mechanical dual combination lock 100 is used as the electronic combination lock 14, the electronic combination lock control circuit receives the predetermined multiple digit combination codes from the combination keypad 56, compares with the authorized combination codes stored in a memory of the electronic circuit board 54, and transmits control signals through the second control output connector 18 to control the electronic and mechanical locking mechanism 60 to lock and unlock the electronic and mechanical dual combination lock 100.

Figure 8:
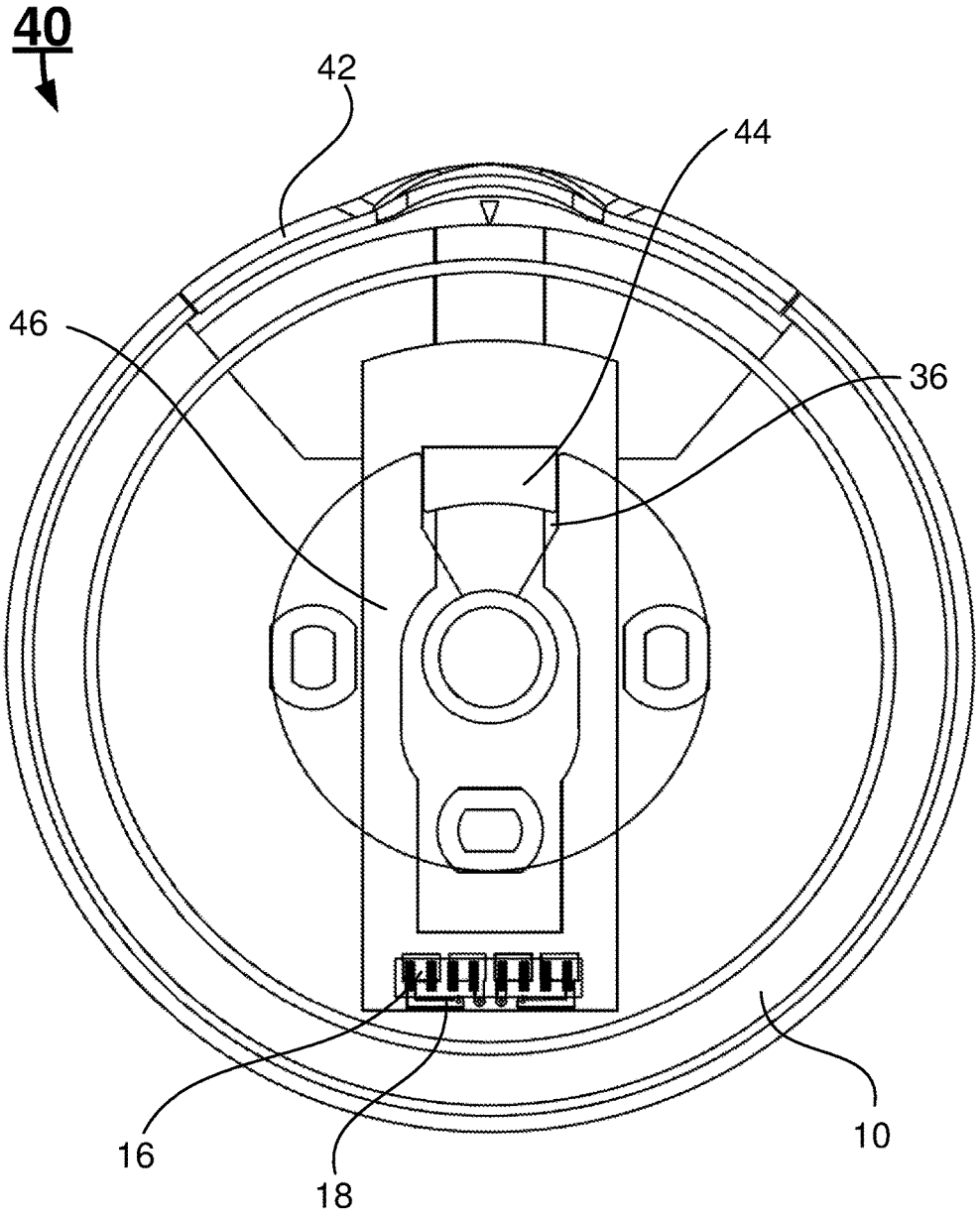
FIG. 8 shows a first control output connector is electrically coupled to a second control output connector when the spin dial release is in the first position and the electronic and mechanical dual combination lock is used as the electronic combination lock according to certain embodiments of the present invention.
Figure 9:
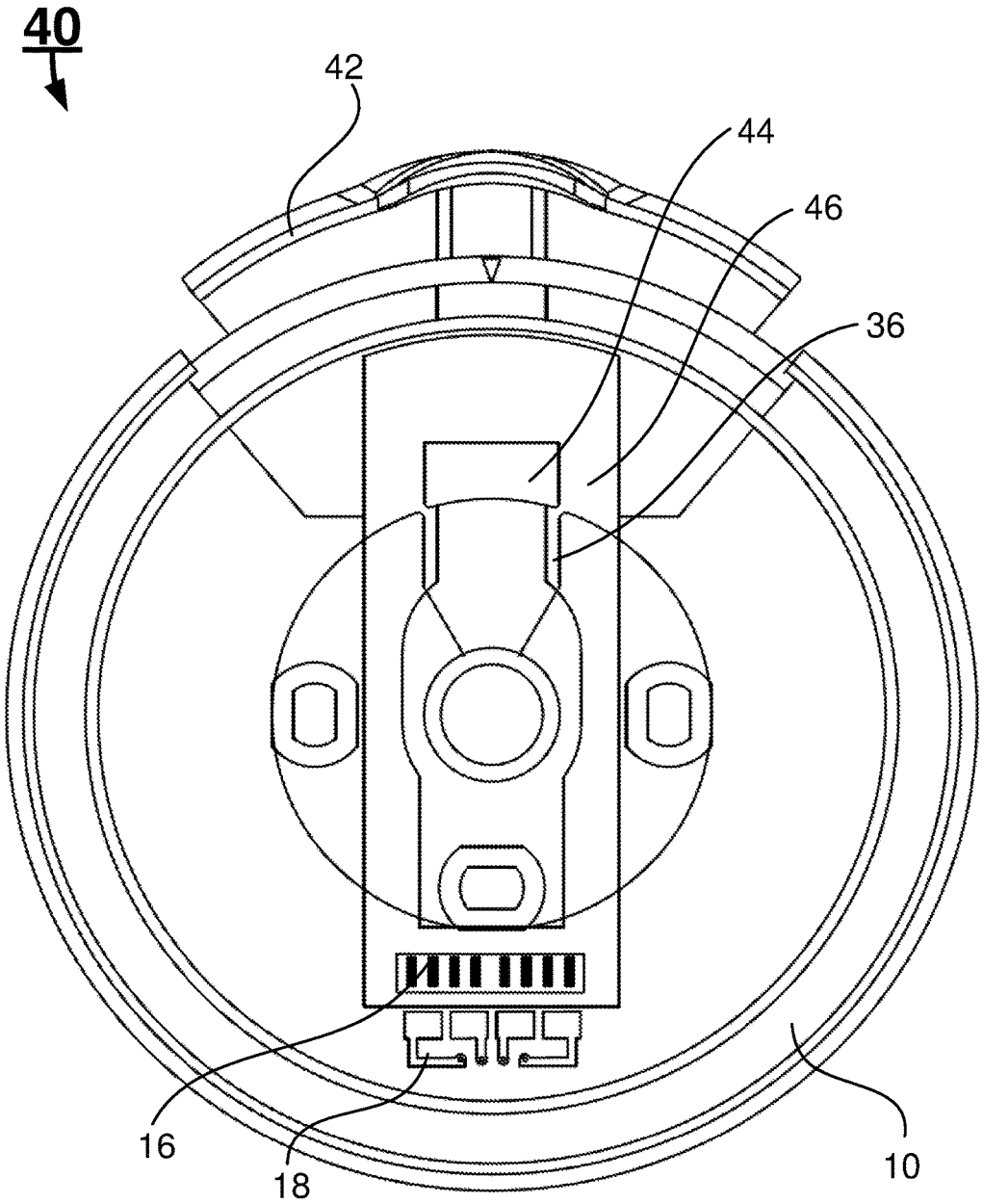
FIG. 9 shows the first control output connector is electrically disconnected from the second control output connector when the spin dial release is in the second position and the electronic and mechanical dual combination lock is used as the mechanical combination lock according to certain embodiments of the present invention.

Referring now to FIGS. 8 and 9, connection and disconnection between the first control output connector 16 and the second control output connector 18 are shown according to certain embodiments of the present invention. The first control output connector 16 has certain control wires electrically coupled to the electronic circuit board 54 as shown in FIG. 6. The first control output connector 16 has a number of contact points, and is installed in the lower end of the elongated spin dial release bar 46. The second control output connector 18 has certain control wires electrically coupled to the electronic and mechanical locking mechanism 60. The second control output connector 18 also has the same number of contact points as the first control output connector 16, and is installed on the lock base 10 as shown in FIG. 7.

When the user wants to use the electronic and mechanical dual combination lock 100 as the electronic combination lock 14, the spin dial release 42 is pressed down to its first position, the first control output connector 16 is engaged with the second control output connector 18, therefore the first control output connector 16 is electrically coupled to the second control output connector 18. When the user wants to use the electronic and mechanical dual combination lock 100 as the mechanical combination lock 12, the spin dial release 42 is lifted up to its second position, the first control output connector 16 is therefore disengaged from the second control output connector 18, therefore the first control output connector 16 is electrically uncoupled to the second control output connector 18. Such arrangement allows the electronic and mechanical dual combination lock 100 performs dual functions: electronic combination lock 14, and mechanical combination lock 12, independently.

In another aspect, the present invention relates to a method of using an electronic and mechanical dual combination lock 100. In certain embodiments, the method includes: installing the electronic and mechanical dual combination lock 100 on a safe, pressing down a spin dial release 42 to a first position to use an electronic combination lock 14 portion of the electronic and mechanical dual combination lock 100, and lifting up the spin dial release 42 to a second position to use a mechanical combination lock 12 portion of the electronic and mechanical dual combination lock 100.

In certain embodiments, the electronic and mechanical dual combination lock 100 includes: a lock base 10, and a spin dial 20. The lock base 10 has a spin dial release conversion mechanism 40. The spin dial 20 has a spin dial cover 22, and the spin dial cover 22 has a combination keypad 56. The lock base 10 includes the mechanical combination lock 12 portion of the electronic and mechanical dual combination lock 100 inside. The electronic combination lock 14 portion of the electronic and mechanical dual combination lock 100 is positioned inside the spin dial cover 22. The combination keypad 56 is used by a user for entering one or more predetermined multiple digit combination codes for locking and unlocking the electronic combination lock 14 portion of the electronic and mechanical dual combination lock 100. The spin dial 20 is used by the user for locking and unlocking the mechanical combination lock 12 portion of the electronic and mechanical dual combination lock 100. An electronic and mechanical locking mechanism 60 is electronically and mechanically coupled to the electronic and mechanical dual combination lock 100 to perform the locking and unlocking operations.

In certain embodiments, the spin dial release conversion mechanism 40 has a spin dial release 42 positioned on the top of the lock base 10. The spin dial release 42 is used by the user to switch the electronic and mechanical dual combination lock 100 between the electronic combination lock 14 and the mechanical combination lock 12. When the spin dial release 42 is placed in a first position, the electronic and mechanical dual combination lock 100 acts as the electronic combination lock 14. When the spin dial release 42 is placed in a second position, the electronic and mechanical dual combination lock 100 acts as a mechanical combination lock 12. The top portion of the spin dial release 42 is in an arc shape, and when the spin dial release 42 is in the first position, the arc shape of the spin dial release 42 forms a part of the circular shape of the lock base 10.

In certain embodiments, the mechanical combination lock 12 includes: multiple wheel packs, a drive cam, and a spin dial release wheel 34. The mechanical combination lock 12 also includes a dial ring 30 on the spin dial release wheel 34. The drive cam is mechanically coupled to the spin dial 20 through a spindle. The spindle is used to turn the wheel packs. The dial ring 30 has many numerical markings 38 displayed along the outer perimeters of the dial ring 30. In one embodiment, the numerical markings 38 include 100 marks: 0 through 99, with the number 00, 10, 20, 30, 40, 50, 60, 70, 80, and 90 engraved along the outer perimeters of the dial ring 30. These numerical markings 38 are used by the user to turn the spindle according to a predetermined sequences for locking or unlocking the mechanical combination lock 12.

In certain embodiments, the spin dial release 42 is installed in the lock base 10. The lock base 10 has a groove and the spin dial release 42 has a protrusion that is installed inside of the grove such that the spin dial release 42 can be slide up and down freely and travel a distance defined by the groove. A spin dial release opening 36 is defined at a top center portion of the spin dial release wheel 34. The spin dial release 42 has an elongated spin dial release bar 46 extending down through an axis of the spin dial 20. The spin dial release bar 46 has a locking block 44. When the spin dial release 42 is pressed down to its first position, the spin dial release 42 is locked by the locking block 44 on the spin dial release 42 through the spin dial release opening 36. When the spin dial release 42 is locked by the locking block 44, the electronic and mechanical dual combination lock 100 is converted to the electronic combination lock 14. When the spin dial release 42 is lifted up to its second position, the locking block 44 on the spin dial release 42 is released from the spin dial release opening 36 of the spin dial release wheel 34. When the locking block 44 on the spin dial release 42 is released from the spin dial release wheel 34, the spin dial 20 can be turned freely, and the electronic and mechanical dual combination lock 100 is converted to the mechanical combination lock 12.

In certain embodiments, the spin dial release 42 includes a light emit diode (LED) light positioned inside the top of the spin dial release 42. The LED light is used to illuminate the numerical markings 38 along the edge of the dial ring 30 when the electronic and mechanical dual combination lock 100 is used as the mechanical combination lock 12. The spin dial cover 22 has many dial ring notches 24 These dial ring notches 24 are used by the user to hold and spin the spin dial 20. The spin dial release wheel 34 also has many spin dial release wheel notches 32. In one embodiment, the spin dial cover 22 has 8 dial ring notches 24, and the spin dial release wheel 34 also has 8 spin dial release wheel notches 32. These notches can be more or less in other embodiments. These spin dial release wheel notches 32 are used to mate with the equal number of dial ring notches 24 of the spin dial cover 22 such that when the spin dial release 42 is in the second position, and when the user turns the spin dial cover 22, the spin dial 20 turns the spin dial release wheel 34 to lock and unlock the mechanic combination lock 12.

In certain embodiments, the electronic combination lock 14 includes: a combination keypad 56, a battery 52, an electronic circuit board 54, a first control output connector 16, and a second control output connector 18. The combination keypad 56 have a number of numerical keys. In one embodiment, the numerical keys include: numerical keys 0 through 9, and a clear key. These numerical keys are used by the user to enter one or more predetermined multiple digit combination codes for locking or unlocking the electronic and mechanical dual combination lock 100. The battery 52 supplies electric power to the electronic combination lock 14. All necessary electronic components for the electronic combination lock 14 are installed on the electronic circuit board 54, and the electronic circuit board 54 is electrically coupled to the combination keypad 56, and the battery 52.

In certain embodiments, the electronic circuit board 54 has an electronic combination lock control circuit. All necessary electronic components of the electronic combination lock control circuit are installed on the electronic circuit board 54. When the electronic and mechanical dual combination lock 100 is used as the electronic combination lock 14, the electronic combination lock control circuit receives the predetermined multiple digit combination codes from the combination keypad 56, compares with the authorized combination codes stored in a memory of the electronic circuit board 54, and transmits control signals through the second control output connector 18 to control the electronic and mechanical locking mechanism 60 to lock and unlock the electronic and mechanical dual combination lock 100.

In certain embodiments, the first control output connector 16 has certain control wires electrically coupled to the electronic circuit board 54. The first control output connector 16 has a number of contact points, and is installed in the lower end of the elongated spin dial release bar 46. The second control output connector 18 has certain control wires electrically coupled to the electronic and mechanical locking mechanism 60. The second control output connector 18 also has the same number of contact points as the first control output connector 16, and is installed on the lock base 10.

When the user wants to use the electronic and mechanical dual combination lock 100 as the electronic combination lock 14, the spin dial release 42 is pressed down to its first position, the first control output connector 16 is engaged with the second control output connector 18, therefore the first control output connector 16 is electrically coupled to the second control output connector 18. When the user wants to use the electronic and mechanical dual combination lock 100 as the mechanical combination lock 12, the spin dial release 42 is lifted up to its second position, the first control output connector 16 is therefore disengaged from the second control output connector 18, therefore the first control output connector 16 is electrically uncoupled to the second control output connector 18. Such arrangement allows the electronic and mechanical dual combination lock 100 performs dual functions: electronic combination lock 14, and mechanical combination lock 12, independently.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope. Accordingly, the scope of the present disclosure is defined by the appended claims rather than the foregoing description and the exemplary embodiments described therein.

What is claimed is:

1. An electronic and mechanical dual combination lock, comprising:

a lock base having a mechanical combination lock positioned inside of the lock base;

a spin dial for the mechanical combination lock;

a spin dial cover having an electronic combination lock positioned inside the spin dial cover, wherein the electronic combination lock comprises a battery configured to power the electronic combination lock, and an electronic keypad on the spin dial cover having a plurality of numerical keys configured to allow the user to enter one or more predetermined multiple digit combination codes for locking or unlocking the electronic combination lock; and a spin dial release conversion mechanism having a spin dial release positioned on the top of the lock base, and configured to switch the electronic and mechanical dual combination lock between the electronic combination lock and the mechanical combination lock independently, wherein when the spin dial release is placed in a first position, the electronic and mechanical dual combination lock is engaged through a first control output connector and a second control output connector to the battery and an electronic circuit board of the electronic combination lock and disengaged to the mechanical combination lock, and when the spin dial release is placed in a second position, the electronic and mechanical dual combination lock is engaged to the mechanical combination lock and disengaged from the battery and the electronic circuit board of the electronic combination lock through the first control output connector and the second control output connector.

2. The electronic and mechanical dual combination lock according to claim 1, wherein when the spin dial release is in the first position, the spin dial release is pressed down, and when the spin dial release is in the second position, the spin dial release is lifted up.

3. The electronic and mechanical dual combination lock according to claim 1, wherein the top portion of the spin dial release is in an arc shape, and when the spin dial release is in the first position, the arc shape of the spin dial release forms a part of the circular shape of the lock base and a dial ring of the mechanical combination lock having numerical marking is covered by the spin dial.

4. The electronic and mechanical dual combination lock according to claim 3, wherein the mechanical combination lock comprises:

a plurality of wheel packs;

a drive cam mechanically coupled to the spin dial through a spindle configured to turn the plurality of wheel packs;

the dial ring having numerical markings configured to allow a user to turn the spindle according to a predetermined sequence for locking or unlocking the electronic and mechanical dual combination lock; and a spin dial release wheel having a spin dial release opening defined at a top center portion, wherein when the spin dial release is in the first position, the spin dial release is locked by a locking block on the spin dial release through the spin dial release opening, converting the electronic and mechanical dual combination lock to the electronic combination lock, and when the spin dial release is in the second position, the locking block on the spin dial release is released from the spin dial release wheel, converting the electronic and mechanical dual combination lock to the mechanical combination lock.

5. The electronic and mechanical dual combination lock according to claim 4, wherein the plurality of numerical markings is displayed along the edge of the dial ring.

6. The electronic and mechanical dual combination lock according to claim 5, wherein the spin dial release comprises a light emit diode (LED) positioned inside the top of the spin dial release configured to illuminate the plurality of numerical markings along the edge of the dial ring.

7. The electronic and mechanical dual combination lock according to claim 3, wherein the spin dial cover comprises a plurality of dial ring notches configured to allow the user to hold and spin the spin dial cover.

8. The electronic and mechanical dual combination lock according to claim 7, wherein the spin dial release wheel comprises a plurality of spin dial release wheel notches configured to mate with the plurality of dial ring notches of the spin dial cover such that when the spin dial release is in the second position, and when the user turns the spin dial cover, the spin dial cover turns the spin dial release wheel to lock and unlock the mechanical combination lock.

9. The electronic and mechanical dual combination lock according to claim 3, wherein the electronic combination lock further comprises:

the electronic circuit board electrically coupled to the combination keypad, and the battery;

the first control output connector having a plurality of control wires to the electronic circuit board; and the second control output connector having a plurality of control wires to an electronic and mechanical locking mechanism, wherein the electronic circuit board comprises an electronic combination lock control circuit configured to receive the predetermined multiple digit combination codes from the combination keypad, compare with the authorized combination codes stored in a memory of the electronic circuit board, and transmit control signals through the second control output connector to the electronic and mechanical locking mechanism to lock and unlock the electronic and mechanical dual combination lock.

10. The electronic and mechanical dual combination lock according to claim 9, wherein when the spin dial release is in the first position, the first control output connector is connected to the second control output connector to engage the electronic combination lock, and when the spin dial release is in the second position, the first control output connector is disconnected from the second control output connector to disengage the electronic combination lock.

11. A method of using an electronic and mechanical dual combination lock comprising:

installing the electronic and mechanical dual combination lock on a safe, wherein the electronic and mechanical dual combination lock comprises:

a lock base having a mechanical combination lock positioned inside of the lock base;

a spin dial for the mechanical combination lock;

a spin dial cover having an electronic combination lock positioned inside the spin dial cover, wherein the electronic combination lock comprises a battery configured to power the electronic combination lock, and an electronic keypad on the spin dial cover having a plurality of numerical keys configured to allow the user to enter one or more predetermined multiple digit combination codes for locking or unlocking the electronic combination lock; and a spin dial release conversion mechanism having a spin dial release positioned on the top of the lock base, configured to switch the electronic and mechanical dual combination lock between the electronic combination lock and the mechanical combination lock independently;

placing the spin dial release in a first position to engage the electronic and mechanical dual combination lock through a first control output connector and a second control output connector to the battery and an electronic circuit board of the electronic combination lock and to use the electronic combination lock, wherein the electronic and mechanical dual combination lock is engaged to the electronic combination lock and disengaged to the mechanical combination lock; and placing the spin dial release in a second position to disengage the electronic and mechanical dual combination lock from the electronic combination lock and to expose a dial ring having numerical markings for the mechanical combination lock and to use the mechanical combination lock, wherein the electronic and mechanical dual combination lock is engaged to the mechanical combination lock and disengaged to the electronic combination lock.

12. The method of claim 11, wherein when the spin dial release is placed in the first position, the spin dial release is pressed down, and when the spin dial release is placed in the second position, the spin dial release is lifted up.

13. The method of claim 11, wherein the top portion of the spin dial release is in an arc shape, and when the spin dial release is in the first position, the arc shape of the spin dial release forms a part of the circular shape of the lock base.

14. The method of claim 13, wherein the mechanical combination lock comprises:

a plurality of wheel packs;

a drive cam mechanically coupled to the spin dial through a spindle configured to turn the plurality of wheel packs;

the dial ring having numerical markings configured to allow a user to turn the spindle for locking or unlocking the electronic and mechanical dual combination lock; and a spin dial release wheel having a spin dial release opening defined at a top center portion, wherein when the spin dial release is in the first position, the spin dial release is locked by a locking block on the spin dial release through the spin dial release opening, converting the electronic and mechanical dual combination lock to the electronic combination lock, and when the spin dial release is in the second position, the locking block on the spin dial release is released from the spin dial release wheel, converting the electronic and mechanical dual combination lock to the mechanical combination lock.

15. The method of claim 14, wherein the dial ring of the mechanical combination lock comprises a plurality of numerical markings along the edge of the dial ring configured for the user to lock and unlock the mechanical combination lock.

16. The method of claim 15, wherein the spin dial release comprises a light emit diode (LED) light positioned inside the top of the spin dial release configured to illuminate the plurality of numerical markings along the edge of the dial ring.

17. The method of claim 13, wherein the spin dial cover comprises a plurality of dial ring notches configured to let the user to hold and spin the spin dial cover.

18. The method of claim 17, wherein the spin dial release wheel comprises a plurality of spin dial release wheel notches configured to mate with the plurality of dial ring notches of the spin dial cover such that when the spin dial release is in the second position, and when the user turns the spin dial cover, the spin dial cover turns the spin dial release wheel to lock and unlock the mechanical combination lock.

19. The method of claim 13, wherein the electronic combination lock further comprises:

the electronic circuit board electrically coupled to the combination keypad, and the battery;

the first control output connector having a plurality of control wires to the electronic circuit board; and the second control output connector having a plurality of control wires to an electronic and mechanical locking mechanism, wherein the electronic circuit board comprises an electronic combination lock control circuit configured to receive the predetermined multiple digit combination codes from the combination keypad, compare with the authorized combination codes stored in a memory of the electronic circuit board, and transmit control signals to the electronic and mechanical locking mechanism through the second control output connector to lock and unlock the electronic and mechanical dual combination lock.

20. The method of claim 19, wherein when the spin dial release is in the first position, the first control output connector is connected to the second control output connector and the electronic and mechanical dual combination lock is engaged to the electronic combination lock and disengaged to the mechanical combination lock, and when the spin dial release is in the second position, the first control output connector is disconnected from the second control output connector and the electronic and mechanical dual combination lock is disengaged to the electronic combination lock and engaged to the mechanical combination lock.

* * * * *